US009475674B2

(12) United States Patent
Benosman et al.

(10) Patent No.: US 9,475,674 B2
(45) Date of Patent: Oct. 25, 2016

(54) CONTROLLING SWAY OF ELEVATOR ROPE USING MOVEMENT OF ELEVATOR CAR

(71) Applicants: Mitsubishi Electric Research Laboratories, Inc., Cambridge, MA (US); Mitsubishi Electric Corporation, Chiyuda-ku, Tokyo (JP)

(72) Inventors: Mouhacine Benosman, Boston, MA (US); Daiki Fukui, Tokyo (JP); Seiji Watanabe, Tokyo (JP); Daisuke Nakazawa, Tokyo (JP)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 608 days.

(21) Appl. No.: 13/933,290

(22) Filed: Jul. 2, 2013

(65) Prior Publication Data

US 2015/0008075 A1 Jan. 8, 2015

(51) Int. Cl.
*B66B 1/28* (2006.01)
*B66B 7/06* (2006.01)

(52) U.S. Cl.
CPC ..... *B66B 7/06* (2013.01)

(58) Field of Classification Search
CPC ..... B66B 7/06
USPC ..... 187/247, 277, 278, 292, 293, 391, 393, 187/412
See application file for complete search history.

(56) References Cited

U.S. PATENT DOCUMENTS 4,271,931 A * 6/1981 Watanabe ..... B66B 1/30 187/292
4,319,665 A * 3/1982 Komuro ..... B66B 1/308 187/296
4,460,065 A 7/1984 Saxer
5,509,503 A 4/1996 Salmon
5,828,014 A * 10/1998 Goto ..... F16F 15/02 187/292
5,861,084 A 1/1999 Barker
5,862,888 A * 1/1999 Iwakiri ..... B66B 7/08 187/292
6,089,355 A * 7/2000 Seki ..... B66B 1/30 187/292
7,164,251 B2 * 1/2007 Morishita ..... G05D 19/02 187/292
7,793,763 B2 9/2010 Zhu
7,905,329 B2 * 3/2011 Urata ..... B66B 5/022 187/278
8,579,089 B2 * 11/2013 Hakala ..... B66B 1/24 187/278
2009/0229922 A1 9/2009 Smith
2013/0173206 A1 * 7/2013 Benosman ..... B66B 7/06 702/141
2014/0069747 A1 * 3/2014 Benosman ..... B66B 7/06 187/414
2014/0124300 A1 * 5/2014 Benosman ..... B66B 7/06 187/247
2015/0027814 A1 * 1/2015 Benosman ..... B66B 5/02 187/247
2015/0251877 A1 * 9/2015 Niikawa ..... B66B 5/04 187/305

* cited by examiner

*Primary Examiner* — Anthony Salata
(74) *Attorney, Agent, or Firm* — Gene Vinokur; James McAleenan; Hironori Tsukamoto

(57) ABSTRACT

A method reduces a sway of an elevator rope supporting an elevator car by controlling a tension of the elevator rope. The tension is controlled using a movement of the elevator sheave according to a control law of the tension of the elevator rope between two points. The first point is associated with a contact of the elevator rope with the elevator sheave. The second point is associated with a contact of the elevator rope with the elevator car or a counterweight of the elevator car. The control law is a function of one or combination of a relative position, a relative velocity and a relative acceleration between the first and the second points.

20 Claims, 12 Drawing Sheets

100

200

200

200

200

301

CONTROLLING SWAY OF ELEVATOR ROPE USING MOVEMENT OF ELEVATOR CAR

FIELD OF THE INVENTION

This invention relates generally to elevator systems, and more particularly to reducing a sway of an elevator rope in an elevator system using movement of the elevator car.

BACKGROUND OF THE INVENTION

Typical elevator systems include a car and a counterweight moving along guiderails in a vertical elevator shaft. The car and the counterweight are connected to each other by hoist ropes. The hoist ropes are wrapped around a sheave located in a machine room at the top or bottom of the elevator shaft. The sheave can be moved by an electrical motor, or the counterweight can be powered by a linear motor.

Rope sway refers to oscillation of the hoist and/or compensation ropes in the elevator shaft. The oscillation can be a significant problem in a roped elevator system. The oscillation can be caused, for example, by vibration due to wind induced building deflection and/or the vibration of the ropes during operation of the elevator system. If the frequency of the vibrations approaches or enters a natural harmonic of the ropes, then the oscillations can be greater than the displacements. In such situations, the ropes can tangle with other equipment in the elevator shaft, or come out of the grooves of the sheaves. If the elevator system uses multiple ropes and the ropes oscillate out of phase with one another, then the ropes can become tangled with each other and the elevator system may be damaged.

Various methods control the sway of the elevator rope by applying tension to the rope. However, the conventional methods use a constant control action to reduce the rope sway. For example, the method described in U.S. Pat. No. 5,861,084 minimizes horizontal vibration of elevator compensation ropes by applying a constant tension on the rope after the vibration of the rope is detected. However, applying a constant tension to the rope is suboptimal, because the constant tension can cause unnecessary stress to the ropes.

Another method, described in U.S. Patent Publication 2009/0229922 A1, is based on a servo-actuator that moves the sheave to shift the natural frequency of the compensation ropes to avoid the resonance of the compensation ropes with the natural frequency of the building. The servo-actuator is controlled by feedback that uses the velocity of the rope vibration at the extremity of the rope. However, that method only solves the problem of compensation rope vibration sway damping. Furthermore, that method necessitates the measurement of the ropes sway velocity at the extremity of the rope, which is difficult in practical applications.

The method described in U.S. Pat. No. 7,793,763 minimizes vibration of the main ropes of an elevator system using a passive damper mounted on the top of the car. The damper is connected to the car and the rope. Distances and a value of the damping coefficient of the damper are used to reduce the rope sway. However, in that method, the number of dampers is proportional to the number of ropes that are controlled. Furthermore, each damper is passive and engages continuously with the rope, which can induce unnecessary extra stress on the ropes.

Other methods, see, e.g., U.S. Pat. No. 4,460,065 and U.S. Pat. No. 5,509,503, use purely mechanical solutions to limit the sway amplitude by physically limiting the lateral motion of the rope. Those types of solutions can be costly to install and maintain.

Accordingly, there is a need to a more optimal approach to reduce the sway of the elevator rope.

SUMMARY OF THE INVENTION

It is an objective of some embodiments of an invention to provide a system and a method for reducing a sway of an elevator rope connected to an elevator car in an elevator system by changing the tension to the rope using a movement of the elevator car.

Some embodiments of this invention are based on a general realization that the elevator ropes tension can be modified based on the relative motion of the two extremity points of the ropes. Additionally or alternatively, some embodiments of this invention are based on a realization that vertical movement of the elevator car induces an extra tension in the ropes. This tension can be used to control the sway of the ropes. If the car vertical motion is properly controlled then the movement of the elevator car can be used to reduce the sway.

For example, in some embodiments, the movement of the elevator car is controlled by causing a main sheave of the elevator system to change a length of the elevator rope of the elevator car or a length of a rope supporting a counterweight of the elevator car. Thus, the sway of the elevator rope can be reduced with a minimal number of actuators or even without the usage of any actuators. Moreover, the movement of the elevator car can control the tension of a multitude of the elevator ropes simultaneously, without the need of any extra device to be added to the elevator system.

The control can be a periodic feedback control until, e.g., maximum amplitude of the sway is below a threshold. Some embodiments of the invention control the movement of the elevator car using a control law including a combination of a function of the state of the sway and a function of the state of the elevator car. Using the control law having such two components allows decoupling the movement of the car for reducing the sway, and the movement of the elevator car for stabilizing the elevator car around an initial position. Stabilizing the car around the initial position can minimize the effect of the sway on the elevator car and can create oscillation movement of the elevator car UP and DOWN around the initial position, which ensures a safety of the elevator system.

For example, some embodiments the function of the state of the elevator car is proportional to a change of the state of the elevator car from the initial position. The further is the elevator car from the initial position than greater is the effect of the function of the state of the elevator car in the control law.

Some embodiments of the invention decouple the effect on the movement of the elevator car resulted from controlling according to the function of the state of the sway from the effect resulted from controlling according to the function of the state of the elevator car. For example, one embodiment determines the function of the state of the sway such that a frequency of the function of the state of the sway is proportional to a frequency of the sway. On the other hand, the embodiment determines the function of the state of the elevator car such that a frequency of the function of the state of the elevator car is different than the frequency of the function of the state of the sway. Such decoupling allows tuning the function to optimize the effect of the functions on both the reduction of the sway and the stability of the elevator car.

Some embodiments of the invention are based on a realization that the tension applied to the elevator ropes can be used to stabilize the elevator system. Therefore, the tension can be analyzed based on the stability of the elevator system using a model of the elevator system. Various types of stability are used by embodiments for solutions of differential equations describing a dynamical system representing the elevator system. For example, one embodiment determines the control law, such that a derivative of a Lyapunov function along dynamics of the elevator system controlled by the control law is negative definite.

Accordingly, one embodiment discloses a method for reducing a sway of an elevator rope supporting an elevator car within an elevator system using an elevator sheave. The method includes controlling, using a movement of the elevator sheave, a tension of the elevator rope according to a control law of the tension of the elevator rope between a first point and a second point, wherein the first point is associated with a contact of the elevator rope with the elevator sheave and the second point is associated with a contact of the elevator rope with the elevator car or a counterweight of the elevator car, wherein the control law is a function of one or combination of a relative position, a relative velocity and a relative acceleration between the first and the second points. The steps of the method are performed by a processor Another embodiment discloses an elevator system including an elevator car supported by an elevator rope in an elevator shaft of the elevator system; a sheave for changing a length of the elevator rope thereby controlling a movement of the elevator car; a sway unit for determining a state of a sway of the elevator rope; a system unit for determining a state of the elevator car; and a control unit for controlling the sheave causing the movement of the elevator car based on the state of the sway of the elevator rope and the state of the elevator car to stabilize a state of the elevator system using the movement of the elevator car.

DETAILED DESCRIPTION OF THE PREFERRED EMBODIMENT

Various embodiments of the invention are based on a realization that tension applied to an elevator ropes can be used to reduce the sway of the ropes in an elevator system. Moreover, this tension can be obtained by controlling movement of the elevator car, e.g., a vertical movement within an elevator shaft, without the need of any extra actuators in the elevator system. For example, various embodiments control the main sheave to move the elevator car up and down around the initial static position, within a specified maximum car vertical motion amplitude, e.g. +3 m to −3 m, in such a way to induce enough tension on the elevator ropes and thus reduce the ropes sway.

Figure 1:
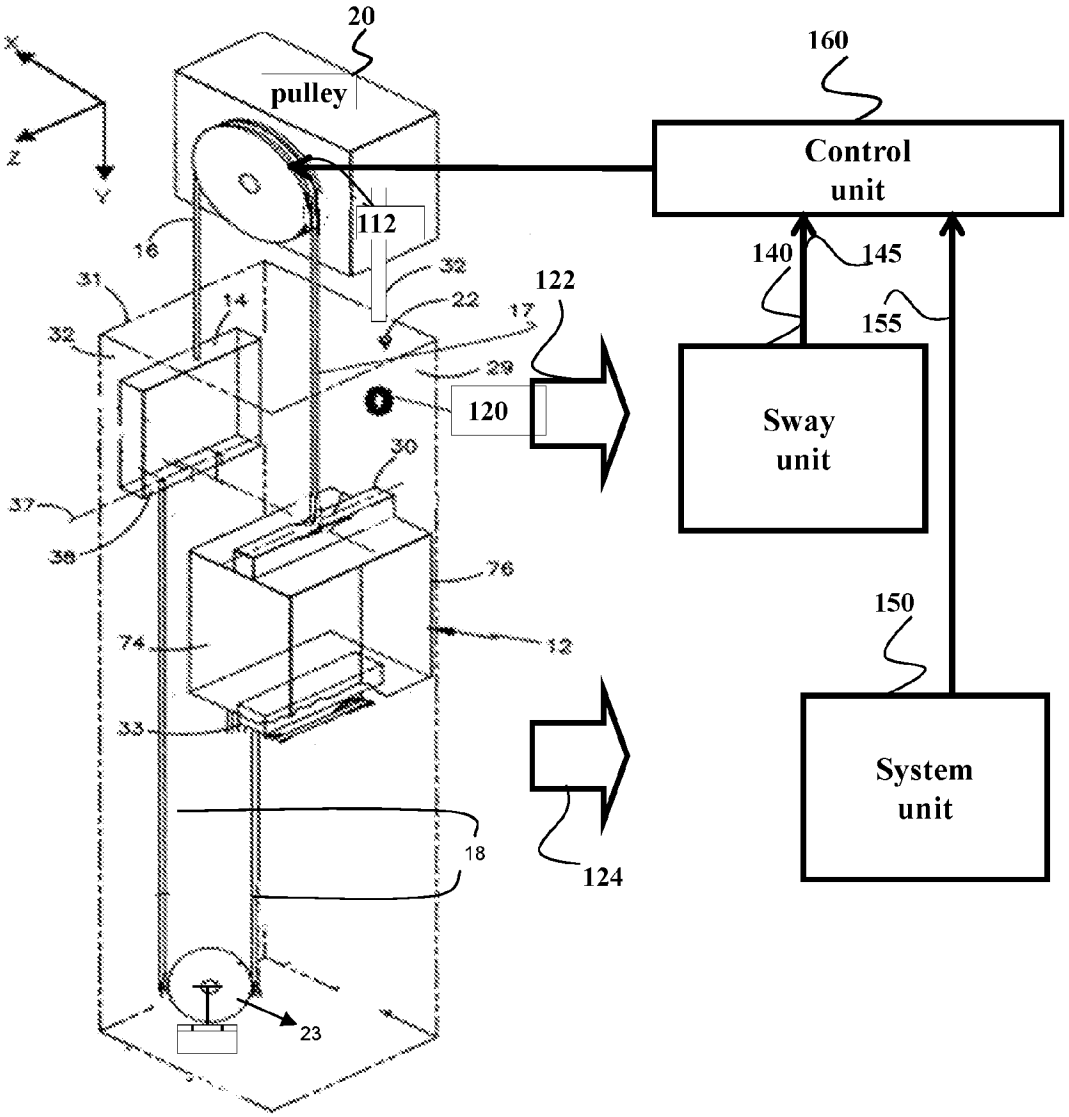
FIG. 1 is a schematic of elevator system according to embodiments of the invention.

FIG. 1 shows a schematic of an elevator system 100 according to one embodiment of an invention. The elevator system includes an elevator car 12 connected by at least one elevator rope to other components of the elevator system. For example, the elevator car and a counterweight 14 connect to one another by main ropes 16-17, and compensating ropes 18. The elevator car 12 can include a crosshead 30 and a safety plank 33. A pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight have a center of gravity at a point where summations of the moments in the x, y, and z directions are zero. In other words, the car 12 or counterweight 14 can theoretically be supported and balanced at the center of gravity (x, y, z), because all of the moments surrounding the center of gravity point are cancel out. The main ropes 16-17 typically are connected to the crosshead 30 of the elevator car 12 where the coordinates of the center of gravity of the car are projected. The main ropes 16-17 are connected to the top of the counterweight 14 the coordinates of the center of gravity of the counterweight 14 are projected.

During the operation of the elevator system, different components of the system are subjected to internal and external disturbance, e.g., sway due to wind, resulting in lateral motion of the components. Such lateral motion of the components can result in a sway of the elevator rope that needs to be measured. Accordingly, one or a set of sway sensors 120 can be arranged in the elevator system to determine a lateral sway of the elevator rope.

The set of sensors may include at least one sway sensor 120. For example, the sway sensor 120 is configured to sense a lateral sway of the elevator rope at a sway location associated with a position of the sway sensor.

However, in various embodiments, the sensors can be arranged in different positions such that the sway locations are properly sensed and/or measured. The actual positions of the sensors can depend on the type of the sensors used. For example, the sway sensor can be any motion sensor, e.g., a light beam sensor.

During the operation of the elevator system, the locations of the sway are determined and transmitted 122 to a sway measurement and estimation unit 140. The sway unit 140 determines a state 145 of the sway of the elevator rope by, e.g., using the sway measurement and an inverse model of the system. Various embodiments use different inverse models, e.g., an inverse model of the elevator system including the rope the pulley and the car, also various embodiments use different estimation method for estimating the rope sway from the measurements.

The state of the sway determined by the unit 140 can include a function of one or combination of an amplitude of the sway, a velocity of the sway, and acceleration of the sway. Example of the function includes, but not limited to, a time-derivative or a time-integral functions.

The system 100 also includes a system unit 150 for determining a state 155 of the elevator car. In some embodiments, the state of the elevator car includes a function of one or combination of a position of the elevator car, a velocity of the elevator car, an acceleration of the elevator car, a position of a counterweight the elevator car, a velocity of the counterweight, and an acceleration of the counterweight.

The system unit 150 can also use measurements transmitted 124 during the operation of the elevator system. For example, the system unit 150 is operatively connected to various positions, velocity and/or acceleration sensors arranged in the elevator system.

In the system 100, the rope sway is controlled by the main sheave 112. The main sheave is controlled by the control unit 160, to move the elevator car up and down to induce an extra tension in the elevator ropes and thus reduces the ropes sway. The control unit also determines the time when the tension is ON and when the tension is OFF based on the rope sway measurements obtained from the sway unit 140.

For example, the main sheave is controlled by the control unit to change a length of the elevator rope, thereby controlling a movement of the elevator car. The control unit controls the main sheave based on the state of the sway of the elevator rope determined by the sway unit 140 and the state of the elevator car determined by the system unit 150. Other modifications of the elevator systems controlling the tension of the rope are possible and within the scope of the invention. The sway unit 140, the system unit 150 and the control unit 160 can be implemented using a processor, e.g., as described below.

Model Based Control Design

FIG. 2 shows an example of a model 200 of the elevator system. The model 200 is based on parameters of the elevator system 100. Various methods can be used to simulate operation of the elevator system according to the model of the elevator system, e.g., to simulate an actual sway 220 of the elevator rope caused by operating the elevator system. The models of other elevator systems can be similarly derived.

Various embodiments can employ different models of the elevator system to design the control law. For example, one embodiment performs the modeling based on Newton's second law. For example, the elevator rope is modeled as a string and the elevator car and the counterweight are modeled as rigid bodies 230 and 250, respectively.

In one embodiment, the model of the elevator system is determined by a partial differential equation according to $$\rho\left(\frac{\partial^2}{\partial t^2} + v^2(t)\frac{\partial^2}{\partial y^2} + 2v(t)\frac{\partial}{\partial y \partial t} + a\frac{\partial}{\partial y}\right)u(y,t) - \frac{\partial}{\partial y}T(y)\frac{\partial u(y,t)}{\partial y} + c(y)\left(\frac{\partial}{\partial t} + v(t)\frac{\partial}{\partial y}\right)u(y,t) = 0, \quad (1)$$

wherein $$\frac{\partial^i}{\partial V^i}(s(V))$$

is a derivative of order i of a function s(•) with respect to its variable V, t is a time, y is a vertical coordinate, e.g., in an inertial frame, u is a lateral displacement of the rope along the x axes, ρ is the mass of the rope per unit length, T is the tension in the elevator rope which changes depending on a type of the elevator rope, i.e., main rope, compensation rope, c is a damping coefficient of the elevator rope per unit length, v is the elevator/rope velocity, and a is the elevator/rope acceleration.

Under the two boundary conditions $$u(0,t)=f_1(t)$$

$$u(l(t),t)=f_2(t), \text{ and}$$

$f_1(t)$ is the first boundary condition representing the top building sway due to external disturbances, e.g. wind conditions, $f_2(t)$ is the second boundary condition representing the car sway due to external disturbances, e.g. wind conditions, l(t) 235 is the length of the elevator rope 17 between the main sheave 112 and the elevator car 12.

Some embodiments of this invention are based on a general realization that the elevator ropes tension can be modified based on the relative motion of the two extremity points of the ropes. Specifically, some embodiments control, using a movement of the elevator sheave, a tension of the elevator rope according to a control law of the tension of the elevator rope between a first point and a second point, wherein the first point is associated with a contact of the elevator rope with the elevator sheave and the second point is associated with a contact of the elevator rope with the elevator car or a counterweight of the elevator car. The control law is a function of one or combination of a relative position, a relative velocity and a relative acceleration between the first and the second points.

Figure 2A:
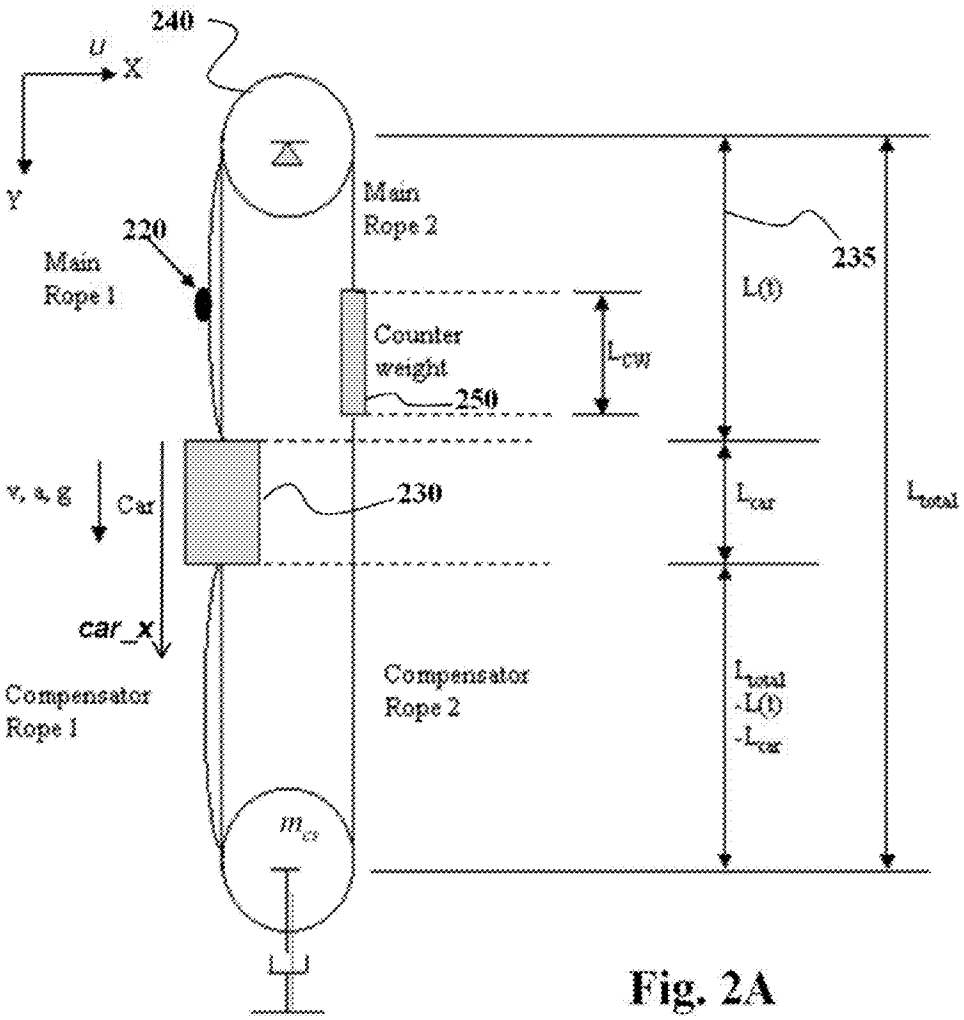
FIGS. 2 A, 2B, 2C, 2D are schematic of a model of the elevator system according to various embodiments of the invention.
Figure 2B:
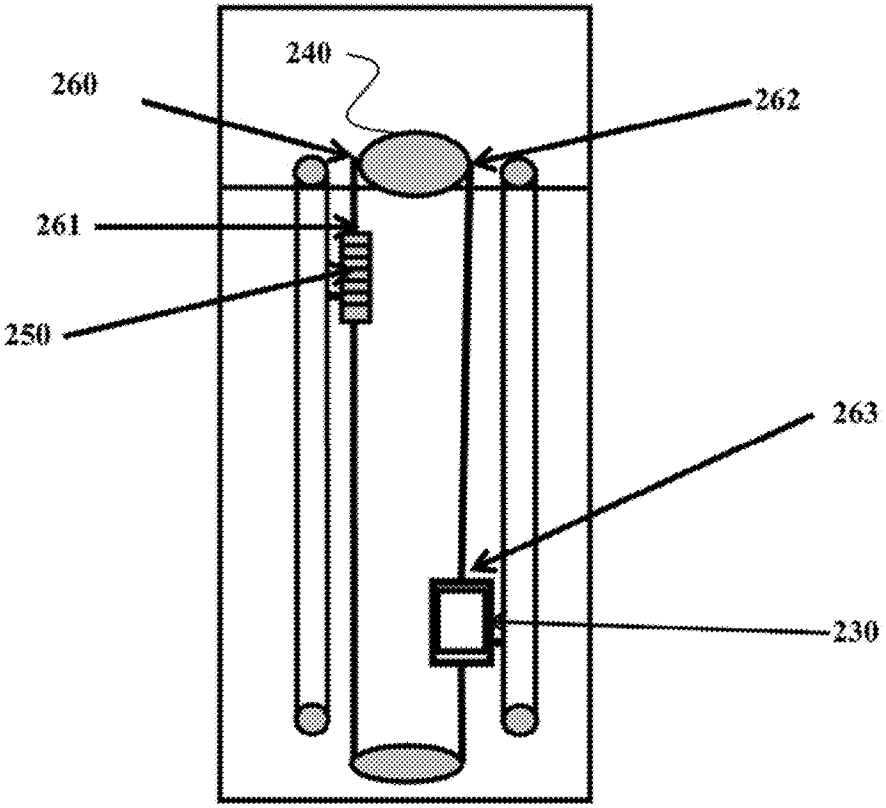

FIG. 2B shows a schematic of one embodiment, wherein the elevator sheave is a main sheave, the elevator rope is a main elevator rope connecting the elevator car or the counterweight with the main sheave, the first point is a point of contact of the main elevator rope with the main sheave, and the second point is a point of contact of the main elevator rope with the elevator car or with the counterweight.

For example, in this embodiment, the main sheave 240 is rotated to control the relative motion between a point of contact 262 or 260 of the main elevator rope and the main sheave and a point of contact 263 or 261 between the main elevator rope and the elevator car 230 or the counterweight 250.

Figure 2C:
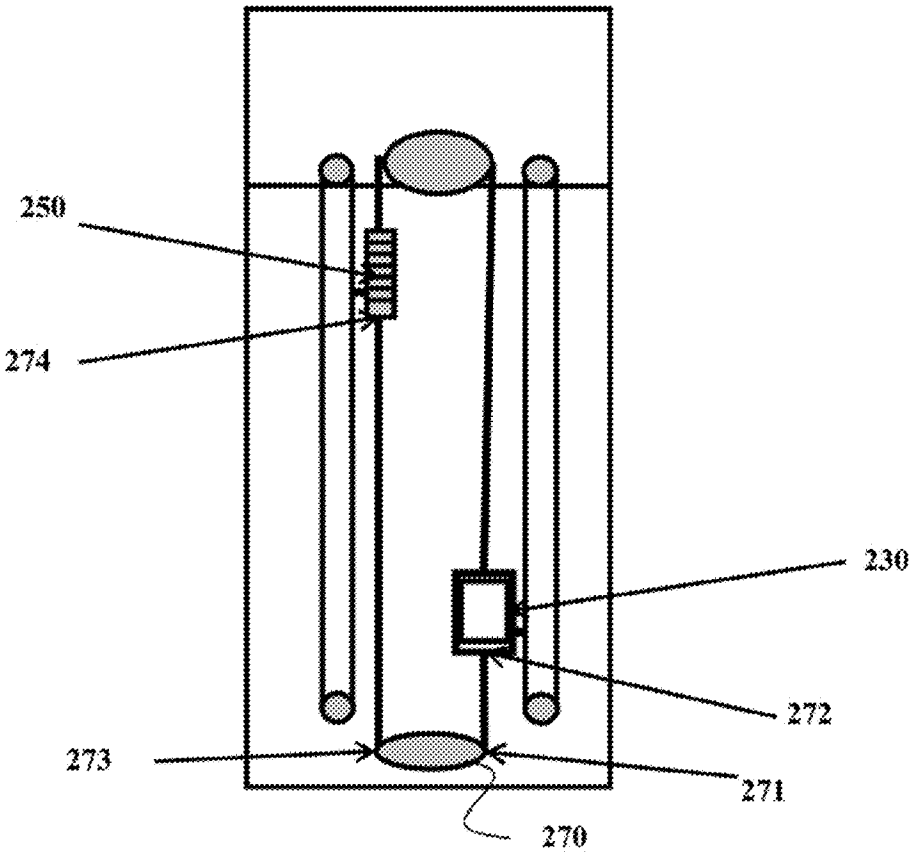

FIG. 2C shows a schematic of another embodiment, wherein the elevator sheave is a compensation sheave, the elevator rope is a compensation rope connecting the elevator car or the counterweight with the compensation sheave. The first point is a point of contact of the compensation rope with the compensation sheave, and the second point is a point of contact of the compensation rope with the elevator car or with the counterweight.

In this embodiment, the main sheave 240 is rotated to control the relative motion between a point of contact 271 or 273 of the compensation rope and the compensation sheave 270 and a point of contact 272 or 274 between the compensation rope and the elevator car 230 or the counterweight 250.

Figure 2D:
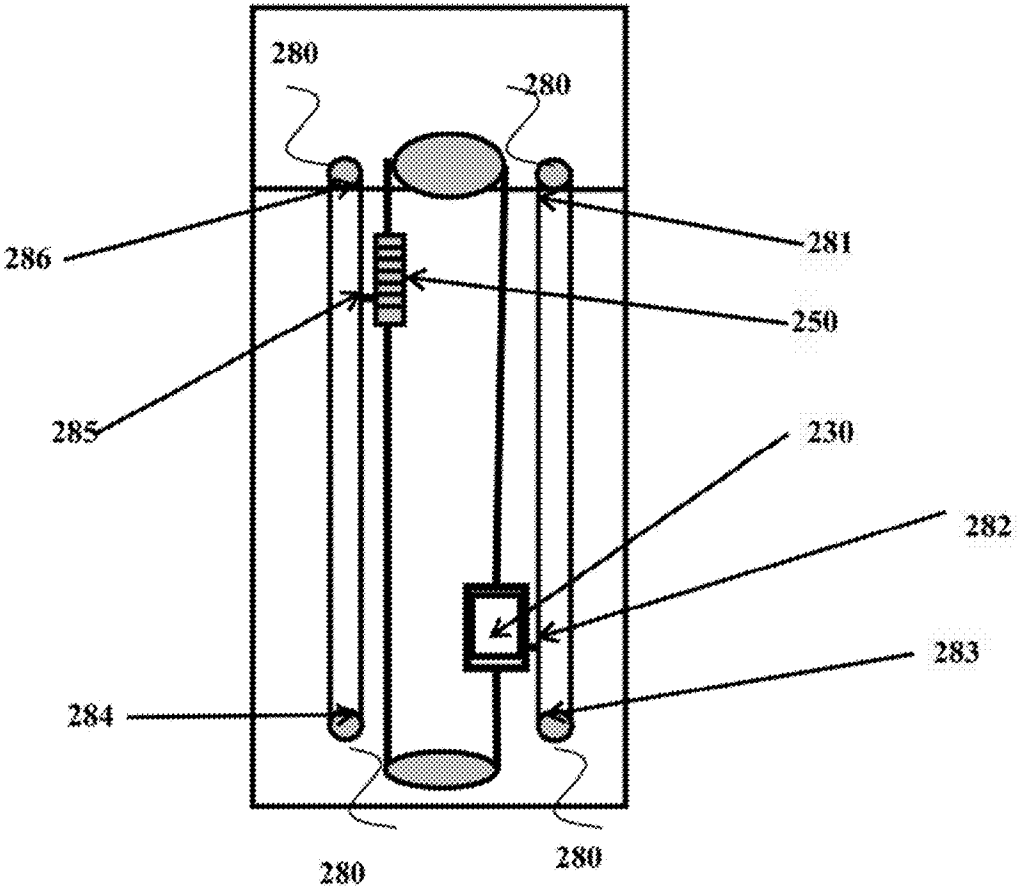

FIG. 2D shows a schematic of yet another embodiment, wherein the elevator sheave is a governor sheave, the elevator rope is a governor rope connecting the elevator car or the counterweight with the governor sheave. The first point is a point of contact of the governor rope with the governor sheave, and the second point is a point of contact of the governor rope with the elevator car or with the counterweight.

In this embodiment, the main sheave 240 is rotated to control the relative motion between a point of contact 286, 284, 281, or 283 of the governor rope and the governor sheave and a point of contact 282 or 285 of the governor rope and the elevator car or the counterweight.

For example, a tension of the elevator rope T can be represented as a function of a movement of the elevator car. For example the tension T can be represented as T=K_rope (car_x−x_u), wherein K_rope is a stiffness of the elevator rope, car_x is the position of the elevator car, and x_u is the position of the contact point between the rope and the main sheave. In some embodiments, the stiffness of the elevator rope is K_rope=E·A/l, wherein E is a Young modulus the elevator rope, A is a cross section of the elevator rope, and l is a length of the elevator rope.

Specifically, the tension of the elevator rope is $$T = (m_e + \rho(l(t) - y))(g + a(t)) + 0.5M_{cs}g + \frac{EA}{l(t)}(\text{car_x} - \text{x_u}),$$

wherein $m_e$, $m_{ex}$ are the masses of the elevator car and the pulley 240 respectively, g is the gravity acceleration, i.e., g=9.8 m/s$^2$ and EA·(car_x−x_u)/l(t) is the extra tension force that is due to the movement of the elevator car. Young modulus, also known as the tensile modulus or elastic modulus, is a measure of the stiffness of an elastic material and is a quantity used to characterize materials, such as the elevator rope.

In one embodiment, the partial differential Equation (1) is discretized to obtain the model based on ordinary differential equation (ODE) according to $$M\ddot{q}+(C+G)\dot{q}+(K+H+\tilde{K})q=F(t) \tag{2}$$

wherein q=[q1, . . . , qN] is a Lagrangian coordinate vector, $\dot{q}$, $\ddot{q}$ are the first and second derivatives of the Lagrangian coordinate vector with respect to time, and N is a number of vibration modes. The Lagrangian variable vector q defines the lateral displacement u(y,t) by $$u(y, t) = \sum_{j=1}^{j=N} q_j(t)\psi_j(y, t) + \frac{l-y}{l} f_1(t) + \frac{y}{l} f_2(t)$$

$$\psi_j(y, t) = \frac{\phi_j(\xi)}{\sqrt{l(t)}}$$

wherein $\phi_j$ (ξ) is a j$^{th}$ shape function of the dimensionless variable ξ=y/l.

In Equation (2), M is an inertial matrix, (C+G) constructed by combining a centrifugal matrix and a Coriolis matrix, (K+H+$\tilde{K}$) is a stiffness matrix and F(t) is a vector of external forces. The elements of these matrices and vector are given by:

$$M_{ij} = \rho\delta_{ij}$$

$$K_{ij} = \frac{1}{4}\rho l^{-2}\dot{l}^2\delta_{ij} - \rho l^{-2}\dot{l}^2\int_0^1 (1-\xi)^2\phi_i'(\xi)\phi_j'(\xi)\,d\xi + \rho l^{-1}(g+\ddot{l})\int_0^1 (1-\xi)\phi_i'(\xi)\phi_j'(\xi)\,d\xi + m_e l^{-2}(g+\ddot{l})\int_0^1 \phi_i'(\xi)\phi_j'(\xi)\,d\xi + \frac{1}{2}M_{cs}gl^{-2}\int_0^1 \phi_i'(\xi)\phi_j'(\xi)\,d\xi$$

-continued $$H_{ij} = \rho(l^{-2}\dot{l}^2 - l^{-1}\ddot{l})\left(\frac{1}{2}\delta_{ij} - \int_0^1 (1-\xi)\phi_i(\xi)\phi_j'(\xi)\,d\xi\right) - c_p\dot{l}l^{-1}\left(\int_0^1 \phi_i(\xi)\phi_j'(\xi)\,d\xi + 0.58_{ij}\right)$$

$$G_{ij} = \rho l^{-1}\dot{l}\left(2\int_0^1 (1-\xi)\phi_i(\xi)\phi_j'(\xi)\,d\xi - \delta_{ij}\right)$$

$$C_{ij} = c_p\delta_{ij}$$

$$F_i(t) = -l\sqrt{l}\,(\rho s_1(t) + c_p s_4(t))\int_0^1 \phi_i(\xi)\xi\,d\xi + \sqrt{l}\,(s_5(t) - \rho f_1^{(2)}(t))\int_0^1 \phi_i(\xi)\,d\xi$$

$$s_5(t) = -2v\rho s_2(t) - g(t)s_3(t) - c_p f_1^{(2)}(t)$$

$$s_1(t) = \frac{\ddot{l}l - 2\dot{l}^2}{l^3} f_1(t) + \frac{\dot{l}}{l^2}\dot{f}_1(t) + \frac{\dot{l}}{l^2}\dot{f}_1(t) + \frac{1}{l^4}\left(l^3 f_2^{(2)}(t) - f_2(t)l^2 l^{(2)} + 2\ddot{l}l^2 f_2(t) - 2l^2\dot{l}\dot{f}_2(t)\right) - \frac{\ddot{f}_1(t)}{l}$$

$$s_2(t) = \frac{\dot{l}}{l^2} f_1(t) - \frac{\dot{f}_1}{l} + \frac{\dot{f}_2}{l} - f_2\frac{\dot{l}}{l^2}$$

$$s_3(t) = \frac{f_2(t) - f_1(t)}{l}$$

$$s_4(t) = \frac{\dot{l}}{l^2} f_1(t) - \frac{\dot{f}_1}{l} + \frac{\dot{f}_2 l - f_2\dot{l}}{l^2}$$

$$\phi_i(\xi) = \sqrt{2}\sin(\pi i\xi),\ \delta_{ij}(\text{kronecker delta})$$

$$\tilde{K} = \beta U,$$

$$U = EA\frac{(\text{car_x} - \text{x_u})}{l(t)}.$$

$$\beta_{ii} = l^{-2}\int_0^1 \varphi_i'^2(\zeta)\,d\zeta,\ \beta_{ij} = 0,\ i \neq j$$

wherein ṡ(•) is a first derivative of a function s with respect to its variable, the notation s$^{(2)}$ (•) is a second derivative of the function s with respect to its variable, and $$\int_{v0}^{vf} s(v)\,dv$$

is an integral of the function s with respect to its variable v over the interval [$v_0$, $v_f$]. The Kronecker delta $\delta_{ij}$ is a function of two variables, which is one when the variables are equal, and zero otherwise.

The control term U as an indirect tension control term, for controlling the tension of the elevator rope indirectly through the movement of the elevator car, e.g., $$U=EA\cdot(\text{car_x}-\text{x_u})/l(t).$$

The model of the elevator can include the model of the elevator rope, and a model the movement of the elevator car. In one embodiment the model of the movement is given by the differential equation $$me\ \text{car_}\ddot{x} = -\frac{EA}{l(t)}(\text{car_x} - \text{x_u}) - \frac{EA}{2l}\int_0^l \frac{\partial u(t, y)}{\partial y}\,dy - \gamma\text{car_}\dot{x}, \tag{3}$$

wherein me is the mass of the elevator car and car_x, car_ẋ, car_ẍ are the vertical position, the velocity and the acceleration of the elevator car, respectively, and γ is damping coefficient of the elevator car.

The system models given by Equation (1) and Equation (2) associated with Equation (3) are two examples of models of the system. Other models based on a different theory, e.g., a beam theory, instead of a string theory, can be used by the embodiments of the invention.

Control Law

Some embodiments of this invention are based on a realization that vertical movement of the elevator car induces an extra tension in the ropes. This tension can be used to control the sway of the ropes. The control can be a periodic feedback control until, e.g., maximum amplitude of the sway is below a threshold.

Figure 3A:
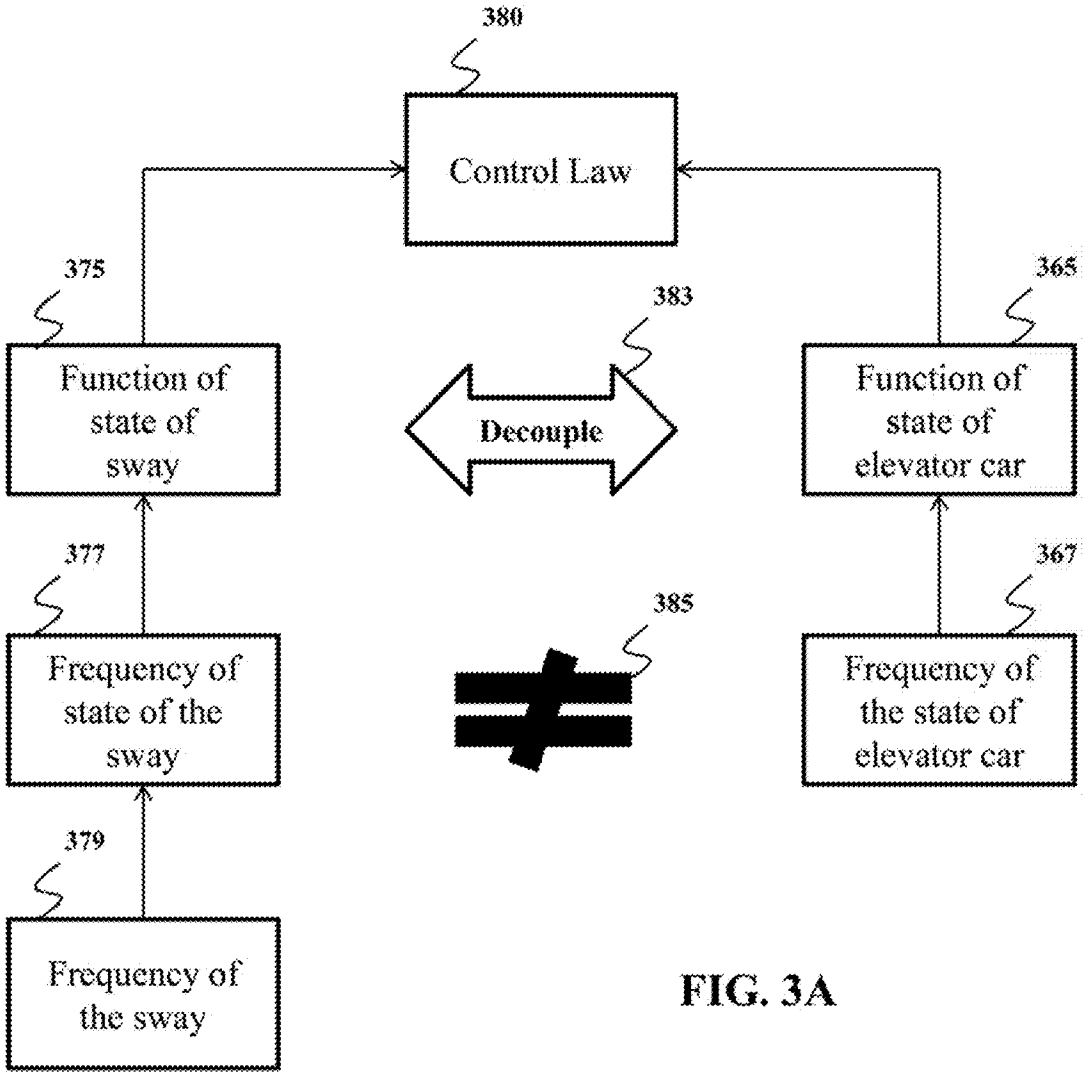
FIGS. 3A, 3B and 3C are block diagrams of methods for controlling an operation of an elevator system according to various embodiments of the invention.

FIG. 3A shows a block diagram illustrating a realization used by some embodiments of the invention to control the movement of the elevator car using a control law 380 for controlling the sway using the movement of the elevator car. The control law 380 includes a combination of a function 375 of the state of the sway and a function 365 of the state of the elevator car. Using the control law having such two components allows decoupling 383 the movement of the car for reducing the sway, and the movement of the elevator car for stabilizing the elevator car around an initial position. Stabilizing the car around the initial position can minimize the effect of the sway on the elevator car and can create oscillation movement of the elevator car UP and DOWN around the initial position, which ensures a safety of the elevator system.

Some embodiments of the invention decouple the effect on the movement of the elevator car resulted from controlling according to the function of the state of the sway from the effect resulted from controlling according to the function of the state of the elevator car. For example, one embodiment determines the function of the state of the sway such that a frequency 377 of the function of the state of the sway is proportional to a frequency 379 of the sway. For example, to achieve such dependency some embodiment design the function 375 using a Lyapunov function along dynamics of the elevator system, as described below.

On the other hand, the embodiment determines the function of the state of the elevator car such that a frequency 367 of the function of the state 365 of the elevator car is different 385 from the frequency 377 of the function 375 of the state of the sway. Such decoupling 383 allows tuning the function to optimize the effect of the functions on both the reduction of the sway and the stability of the elevator car.

Some embodiments determine the control law to control the main sheave 112. The main sheave 112 moves the car up and down based on the control law. One embodiment determines the control law for the case of one assumed mode, i.e., equation (2) with N=1, as described below. However, other embodiments similarly determine the control law for any number of modes. In various embodiments, the assumed mode is a mode of vibration of the elevator rope characterized by a modal frequency and a mode shape, and is numbered according to the number of half waves in the vibration of the elevator rope.

Some embodiments of the invention are based on a realization that the tension applied to the elevator ropes can be used to stabilize the elevator system. Therefore, the tension can be analyzed based on the stability of the elevator system using a model of the elevator system. Various types of stability are used by embodiments for solutions of differential equations describing a dynamical system representing the elevator system. For example, one embodiment determines the control law, such that a derivative of a Lyapunov function along dynamics of the elevator system controlled by the control law is negative definite.

Figure 3B:
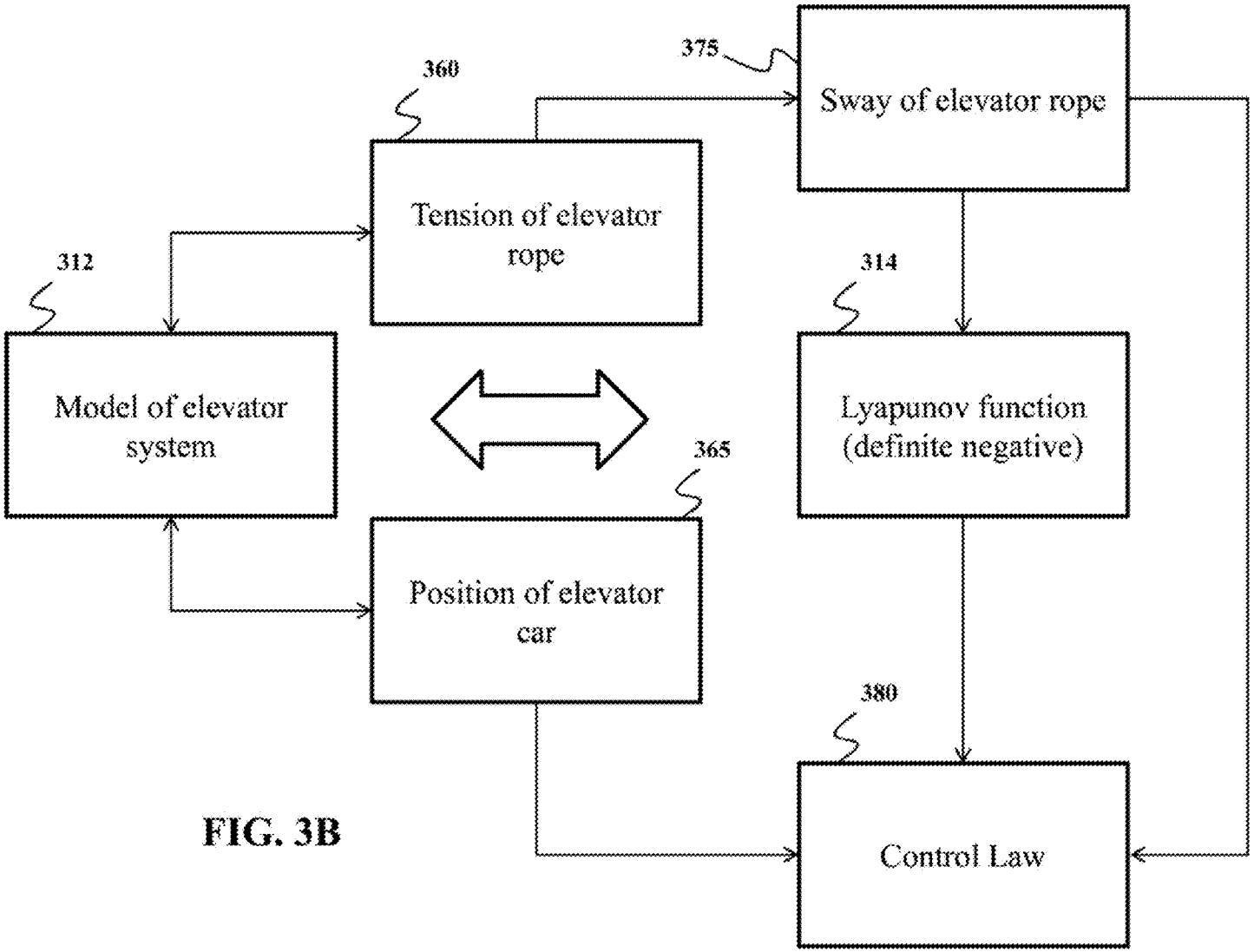

FIG. 3B shows a block diagram illustrating some principles employed by some embodiments of the invention. The tension of the elevator rope T 360 can be represented as the function of the state of the elevator car 365 based on the model of elevator system 350. Specifically, the tension can be represented as T=EA(car_x−x_u)/l. The function of the state of the sway 375 depends on the tension of the elevator rope 360, and thus depends on the state of the elevator car.

For example, one embodiment of the invention determines the sway of the elevator rope supporting the elevator car in a initial position within an elevator shaft of the elevator system and generates a command to change the position of the elevator car in response to detecting the sway. In one embodiment, the position is changed by controlling a movement of the elevator car around that initial position.

Similarly, a Lyapunov function 370 along dynamics of the elevator can also be determined based on the model 350 of the elevator system. Moreover, the Lyapunov function can be determined as the function of state of the sway 375. For example, the Lyapunov function can include an amplitude of the sway represented by a Lagrangian variable q and a velocity of the sway represented by a derivative of the Lagrangian variable $\dot{q}$.

Accordingly, it is possible to control the sway of the elevator rope in accordance with a Lyapunov theory by controlling the movement of the elevator car. This realization allows designing a control law for controlling the position of the elevator car to stabilize the elevator system and to reduce the sway of the elevator rope. For example, one embodiment determines a control law 380 for controlling a control term U=EA(car_x−x_u)/l as a function U $(q,\dot{q})$ of the amplitude and the velocity of the sway represented by the Lagrangian variables, such that a derivative of a Lyapunov function is negative definite, and controls the movement of the elevator car according to the control law. Explanation of the Lyapunov theory and example of the Lyapunov function are provided below.

Figure 3C:
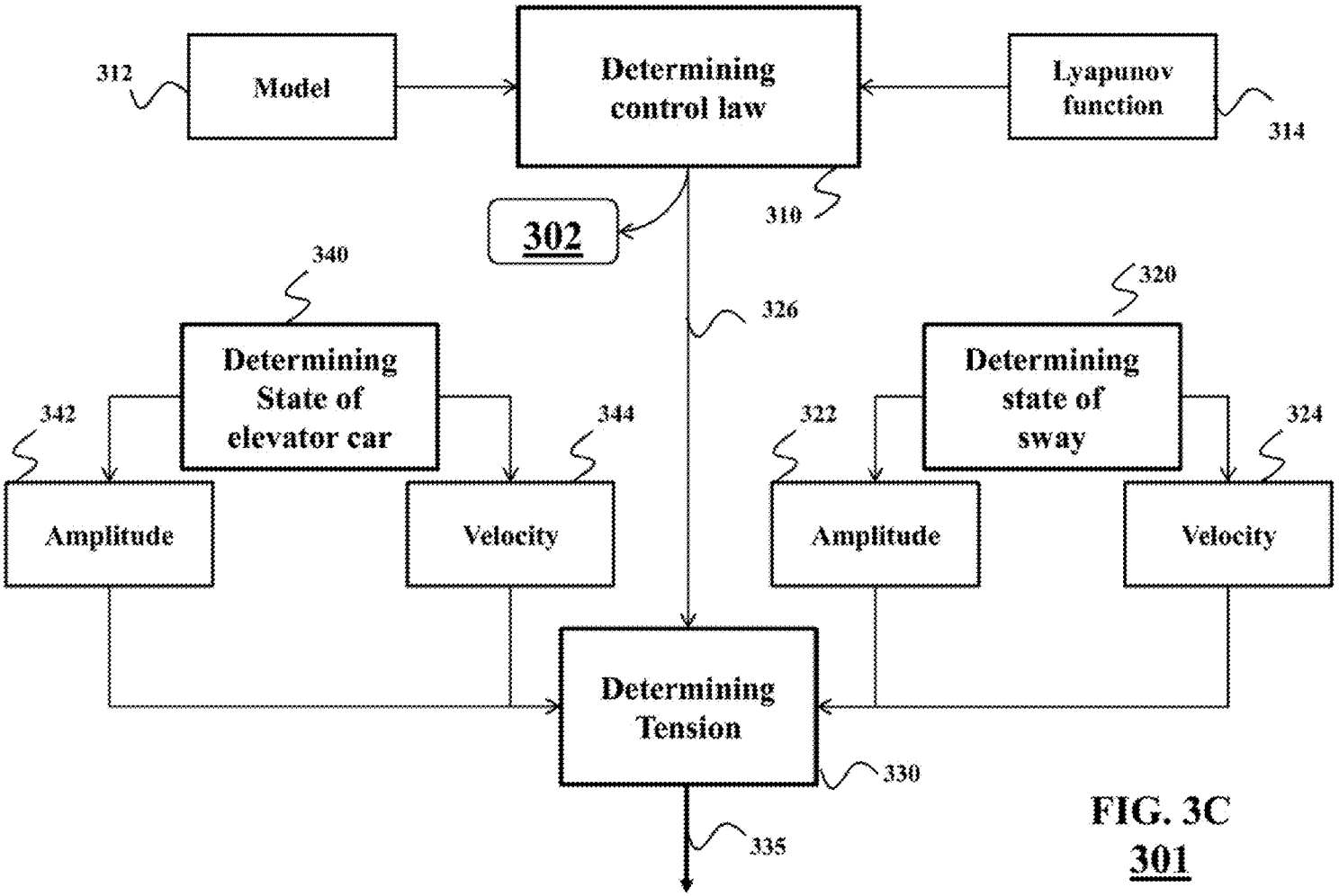

FIG. 3C shows a block diagram of a method employing some principles discuss above in connection with FIGS. 3A-B. The method controls an operation of an elevator system and can be implemented by a processor 301. The method determines 310 a control law 326 stabilizing a state of the elevator system using the movement 335 of the elevator car.

In various embodiments, the control law is a combination of a function of the state of the sway and a function of the state of the elevator car. The control law can be stored into a memory 302. The memory 302 can be of any type and can be operatively connected to the processor 301.

In some embodiments, the state of the elevator car includes an amplitude 342 and a velocity 344 of the elevator car. For example, the amplitude 342 can be determined from the initial position of the elevator car when the sway is detected. In some embodiments, in response to the detection of the sway, the elevator car stops at the nearest floor to unload the passengers, and the initial position is the position at that floor. Inclusion of the state of the elevator system in the control law allows to put limits on the maximum position and/or velocity of the elevator car imposed by constraints of the elevator system or business requirement, as described in more details below.

In other embodiments, the state of the elevator car includes a function of one or combination of a position of the elevator car, a velocity of the elevator car, an acceleration of the elevator car, a position of a counterweight the elevator car, a velocity of the counterweight, and an acceleration of the counterweight. Example of the function includes, but not limited to, a time-derivative or a time-integral functions.

In some embodiments, the state of the sway includes an amplitude 322 and a velocity 324 of the sway. Generally, the state of the sway can include a function of one or combination of an amplitude of the sway, a velocity of the sway, and acceleration of the sway of the elevator rope in the elevator system. In one embodiment, the elevator rope supports the elevator car within an elevator system. But the sway of other elevator rope, e.g., a sway of the rope supporting a counterweight of the elevator car, can also be used. Example of the function includes, but not limited to, a time-derivative or a time-integral functions.

In some embodiments the control law is determined such that a derivative of a Lyapunov function 314 along dynamics of the elevator system controlled by the control law is negative definite. Such requirement ensures the stabilization of the elevator system and reduction of the sway. Also, determining the control based on Lyapunov theory allows applying the tension optimally, i.e., only when necessary to reduce the sway, and thus reduce the maintenance cost of the elevator system. For example, in one embodiment the control law is determined such that the tension of the elevator rope is proportional to the amplitude and velocity of the sway of the elevator rope.

In some embodiments, the control law is determined such that the tension is applied only in response to increasing of the amplitude of the sway of the rope. Thus when the sway is present, but is reducing during other factors of the operation of the elevator system, the tension is not applied. For example, the tension can be applied based on a sign of a product of the amplitude of a sway of the rope and the velocity of the sway of the rope. Also, in some embodiments, the function of the state of the elevator car is proportional to a change of the state of the elevator car from the initial position.

During the operation of the elevator system, the method determines 320 the state of the sway including, e.g., the amplitude 322 of the sway of the elevator rope and the velocity 324 of the sway of the elevator rope. For example, the amplitude and the velocity can be directly measured using various samples of the state of the elevator system. Additionally or alternatively, the amplitude and the velocity of the sway can be estimated using, e.g., a model of the elevator system and reduce number of samples, or various interpolation techniques. At the same time the method determines 340 the state of the elevator car, including, e.g., the amplitude 342 of the elevator car and the velocity 344 of the elevator car. For example the amplitude and the car can be measured using direct amplitude and velocity sensors mounted on or around the car. Additionally or alternatively, the amplitude and the velocity of the car can be obtained using the car acceleration measured using a accelerometer. Additionally or alternatively, the amplitude and the velocity of the elevator car can be estimated using, e.g., a model of the elevator system and various estimation techniques.

Next, the movement 335 of the elevator car is controlled based on the control law 326, and the amplitude 322 and the velocity 324 of the sway of the elevator rope, as well as, the amplitude 342 and the velocity 344 of the elevator car. In some embodiments, the controlling causes a main sheave to change a length of the elevator rope of the elevator car or a length of a rope supporting a counterweight of the elevator car. Also, the determining and the controlling the movement 335 can be performed periodically, e.g., until a maximum amplitude of the sway is below a threshold.

Lyapunov Control

Some embodiments use the tension of the rope and the Lyapunov theory to stabilize the elevator system, and thus stabilize the sway. By combining the Lyapunov theory and position of the elevator car causing the rope tension actuation, some embodiments optimize switching the control tension ON and OFF based on switching conditions, e.g., amplitude and velocity of the actual sway. The switching condition as well as the amplitude of the positive tension to be applied is obtained based on the Lyapunov theory.

One embodiment defines a control Lyapunov function V(x) as $$V(x) = \frac{1}{2}\dot{q}^T(t)M\dot{q}(t) + \frac{1}{2}q^T(t)Kq(t),$$

wherein, q, $\dot{q}$ are the Lagrangian variables representing the assumed mode and its time derivative, M, K are the mass and the stiffness matrix respectively, defined in the model of Equation (2), and $x=[q, \dot{q}]^T$.

If assumed mode is one, the Lagrangian variables q, $\dot{q}$ are related to the sway u(y,t) and the sway velocity du(y,t)/dt by the equations $$u(y, t) = \frac{\sqrt{2}\sin\left(\frac{\pi y}{l}\right)q(t)}{\sqrt{l}};$$

$$\frac{du(y, t)}{dt} = \frac{\sqrt{2}\sin\left(\frac{\pi y}{l}\right)q(t)}{\sqrt{l}}.$$

The Lagrangian variables q, $\dot{q}$ can be determined based on the amplitude u(y,t) and velocity du(y,t)/dt sway. For example, one embodiment determines the Lagrangian variables according to $$q(t) = \frac{\sqrt{l}\,u(y, t)}{\sqrt{2}\sin\left(\frac{\pi y}{l}\right)},$$

$$\dot{q}(t) = \frac{\sqrt{l}\,du(y, t)/dt}{\sqrt{2}\sin\left(\frac{\pi y}{l}\right)}.$$

The sway amplitude u(y,t) and velocity du(y,t)/dt can be directly measured or estimated using various methods. For example, one embodiment determines the sway using sway sensors sensing the sway of the elevator rope at sway locations. Another embodiment determines the amplitude of the sway using samples of the sway and the model of the system. After the sway amplitude is determined, some embodiment determines the sway velocity using, e.g., a first order derivative $$\frac{du(y, t)}{dt} = \frac{u(y, t+\delta t) - u(y, t)}{\delta t},$$

wherein δt is the time between two sway amplitude measurements or estimations.

Some embodiments, determines the control law such that a derivative of the Lyapunov function along dynamics of the elevator system controlled by the control law U is negative definite. One embodiment determines the derivative of the Lyapunov function along the dynamics, e.g., represented by Equation (2), of the elevator system without disturbances, i.e. F(t)=0 for all t., according to $$\dot{V}(x) = \dot{q}(-c\dot{q} - kq - \beta Uq) + kq\dot{q}$$
$$= -c\dot{q}^2 - \beta Uq\dot{q},$$

wherein coefficients c,k and β are determined according to the Equation (2).

To ensure the negative definiteness of the derivative $\dot{V}$, the control law according to one embodiment includes $$U(q,\dot{q})=\tilde{k}q\dot{q},\tilde{k}>0. \quad (4)$$

In another embodiment the control law includes $$U(q,\dot{q}) = \begin{cases} \text{u_max} & \text{if } \dot{q}q > 0 \\ u^* & \text{if } \dot{q}q \le 0 \end{cases}. \quad (5)$$

In some embodiments u* is less or equals zero and more or equals −u_max. This control law switches between two constants, e.g., u* and u_max, which is positive constant representing the maximum tension control. The tension applied to the elevator rope according this control law has a constant value, e.g., a maximum tension. A controller according to a control law (5) stabilizes the elevator system with no disturbance by switching between a maximal and a minimal control. This controller is easy to implement and is advantageous when the disturbance is unknown or minimal.

For example, in some embodiments the tension is applied based on a sign of a product of the amplitude of a sway of the rope and the velocity of the sway of the rope. The product is determined and the sign is tested. If the sign is positive, then a maximum tension is applied. If the sign is negative, then a minimum tension is applied, e.g., no tension is applied, i.e., U=0.

In an alternative embodiment that ensures the negative definiteness of the derivative $\dot{V}$ is as follows: the tension applied according to a varying function of the amplitude and the velocity of the sway. In comparison with the previous embodiment, this embodiment can be advantageous because the embodiment uses less energy to control the sway.

According to this embodiment, the control law U(x) is $$U(x) = \begin{cases} \dfrac{kq\dot{q}}{\sqrt{1+(q\dot{q})^2}} & \text{if } \dot{q}q > 0,\ 0 < k \le \text{u_max} \\ 0 & \text{if } \dot{q}q \le 0 \end{cases}, \quad (6)$$

wherein k is a positive feedback gain.

This choice of controller law (6) also ensures that derivative of Lyapunov function is definite negative $$\dot{V}(x)\le 0.$$

The positive varying tension control decreases with the decrease of the amplitude of the product $q\dot{q}$, which means when the sway amplitude gets smaller the tension applied to control also gets smaller. Thus, this varying control law uses less control energy.

Under the control according to the control law of Equation (6), the amplitude of the control decreases with the decreasing amplitudes of q, $\dot{q}$, and $|U|\le u_{max}$. Thus, the control law is determined such that the tension of the elevator rope is proportional to the amplitude of the sway of the elevator rope, and uses high control tension when the sway or its velocity is high, because when the product q, $\dot{q}$ decreases, the control tension also decreases.

Reduction of Sway Using Movement of the Elevator Car

A control law for controlling a control term U=EA (car_x−x_u)/l can be determined as a function U (q,$\dot{q}$) of the amplitude and the velocity of the sway represented by the Lagrangian variables, such that a derivative of a Lyapunov function is negative definite. The function U(q,$\dot{q}$) can be any control function described above, such as function according to Equations (4), (5), or (6). However, such control laws do not impose any limits on the maximum position and/or velocity of the elevator car, which can be disadvantageous for some applications.

For example, in one embodiment the model of the elevator car is $$me\ \text{car_}\ddot{x} = -\frac{EA}{l(t)}(\text{car_x} - \text{x_u}) - \frac{EA\pi^2}{2l^3}q^2 - \gamma\text{car_}\dot{x},$$

the control term is U=EA (car_x−x_u)/l, and the control law is $$U(q,\dot{q})=\tilde{k}q\dot{q},\tilde{k}>0.$$

In this embodiment, the main sheave is used to reproduce the desired position of the point x_u as $$x_u=\text{car_}x-l(\tilde{k}q\dot{q})/EA,$$

and the differential equation of the model of the elevator car can be rewritten according to $$me\ \text{car_}\ddot{x} = -\tilde{k}q\dot{q} - \frac{EA\pi^2}{2l^3}q^2 - \gamma\text{car_}\dot{x}.$$

This equation shows that there is no control on the movement of the elevator car, i.e., the elevator car can move to any point without stopping. Some embodiment address this issue by modifying the control law with a function of a position and a velocity of the elevator car, such that the control law W(x) includes $$W(x)=U(q,\dot{q})+Kp\text{car_}x+Kv\text{car_}\dot{x}, \quad (7)$$

wherein x is the position of the elevator car within the elevator shaft, car_x is the position of the elevator car, car_$\dot{x}$ is the velocity of the elevator car, Kp is a position gain of the control law, Kv is a velocity gain of the control law.

For instance, in the embodiment with control term U(q,$\dot{q}$)=$\tilde{k}q\dot{q}$, $\tilde{k}$>0, the modified control law W(x) includes $$W(x)=\tilde{k}q\dot{q}+Kp\text{car_}x+Kv\text{car_}\dot{x},$$

wherein $\tilde{k}$ is a sway gain, wherein the sway gain, the position gain, and the velocity gain are positive.

Figure 4A:
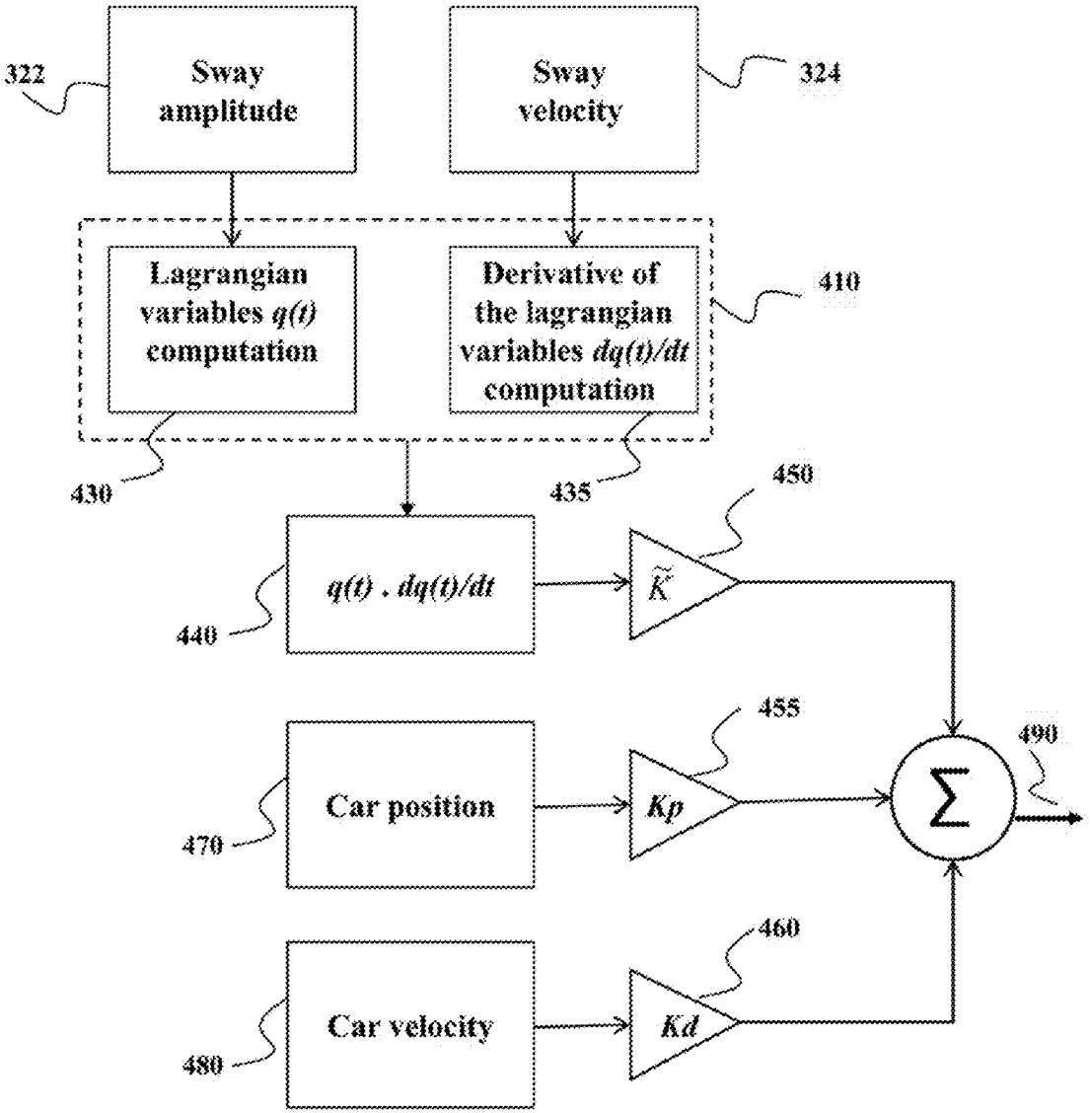
FIG. 4A is a block diagram of a method for computing a tension control and controlling an operation of an elevator system according to an embodiment of the invention.

FIG. 4A shows a block diagram of a method for determining the control law based on Lyapunov theory. The Lagrangian variables q, $\dot{q}$ 430 and 435 are determined 410 based on the amplitude u(y,t) 322 and velocity du(y,t)/dt 324 sway. The control law of this embodiment includes three control terms. A first control term is the function of the state of the sway and includes a product of the Lagrangian variable and its derivative 440 and the sway gain 450. A second control term and a third control terms from the function of the state of the elevator car. For example, the second term includes a product of a position of the elevator car 470 and a position gain Kp 455. The third control term includes a product of a velocity of the elevator car 480 and a velocity gain Kd 460. The control law includes a sum 490 of these three terms.

Figure 4B:
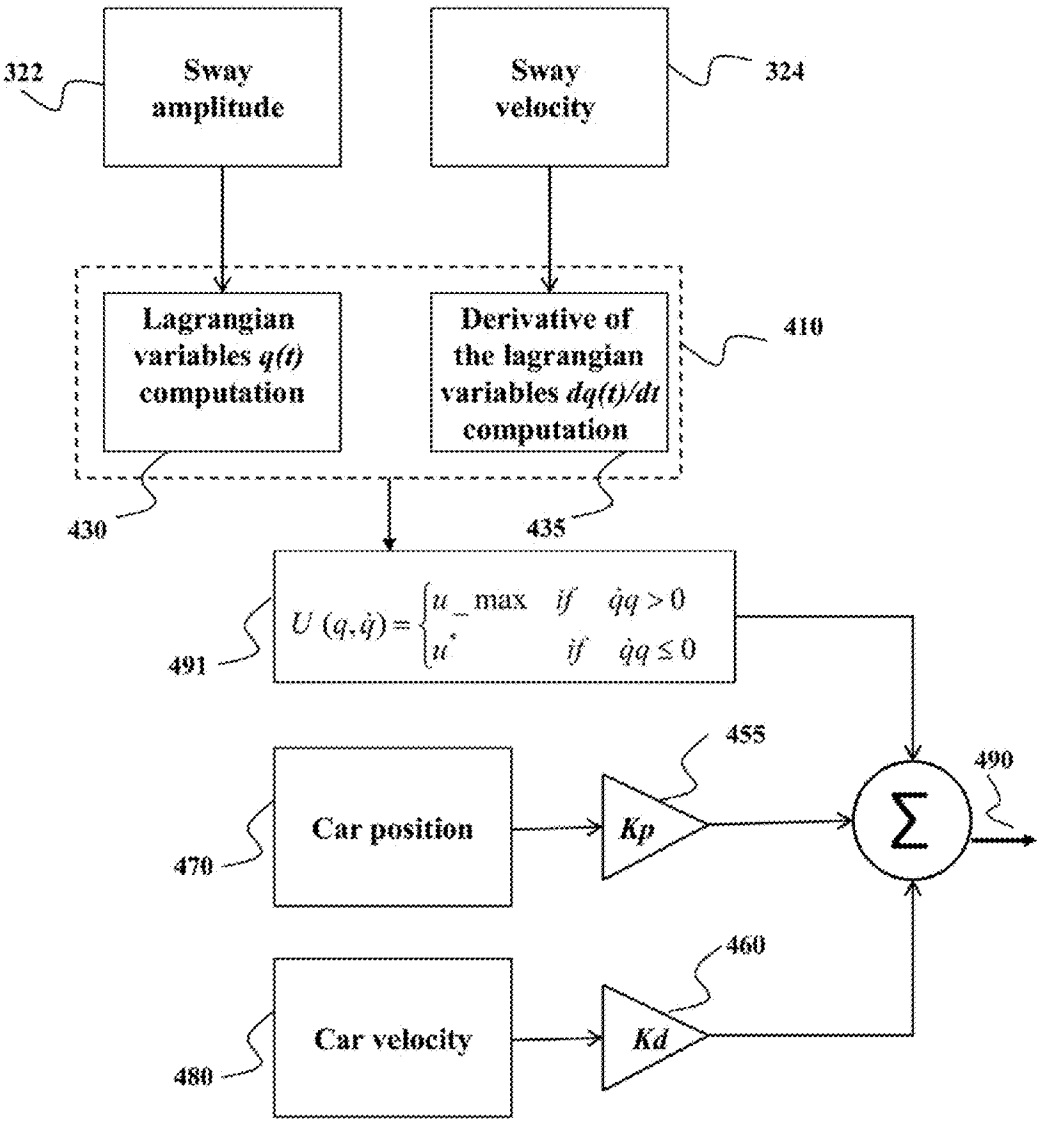
FIG. 4B is a block diagram of a method for computing a tension control and controlling an operation of an elevator system according to an embodiment of the invention.

FIG. 4B shows a block diagram of a method for determining the control law according to another embodiment. In this embodiment s, the control term U in equation (7) is replaced by the control term of Equation (5). The Lagrangian variable q 430 and the Lagrangian variable derivative dq/dt 435 are used to compute a control term 491 based on Equation (5).

Figure 4C:
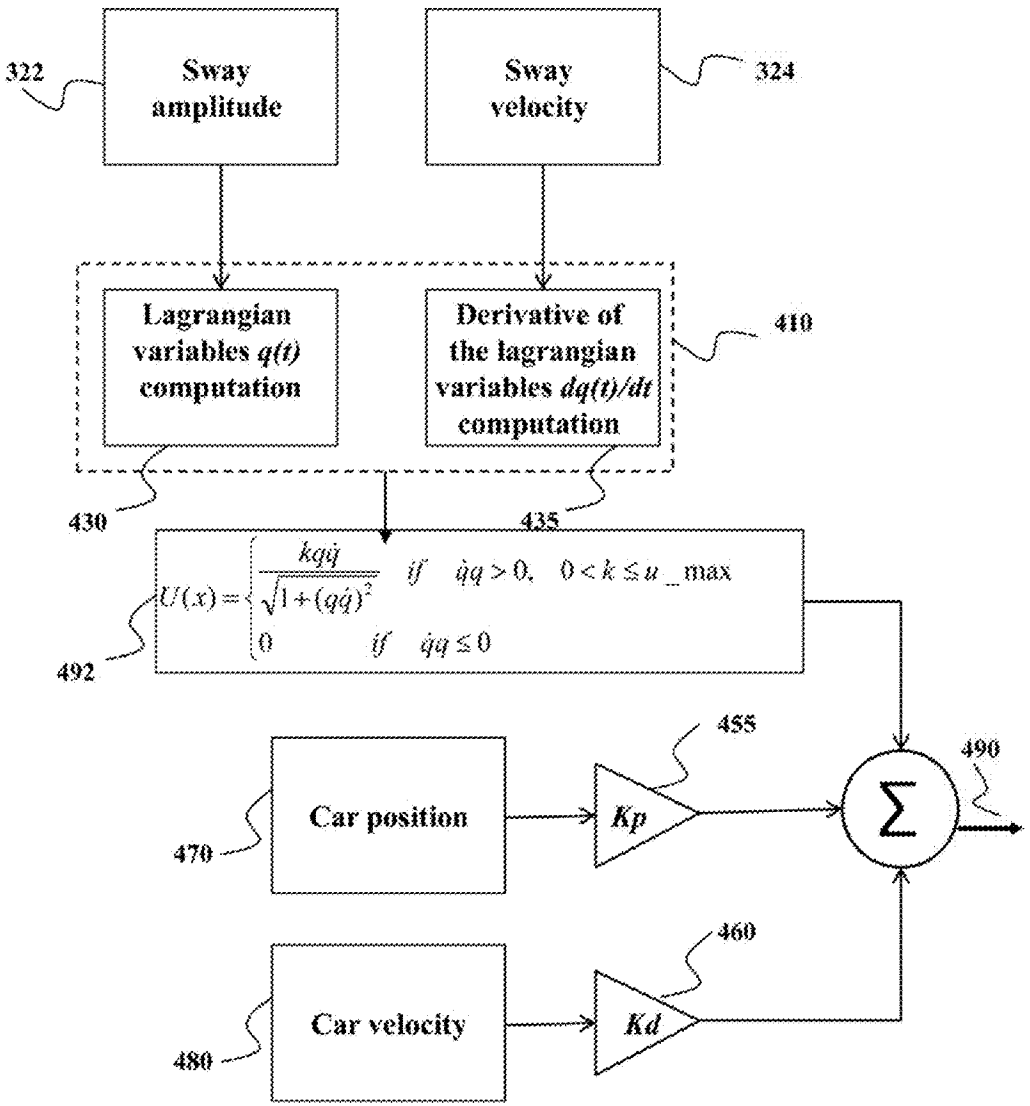
FIG. 4C is a block diagram of a method for computing a tension control and controlling an operation of an elevator system according to an embodiment of the invention.

FIG. 4C shows a block diagram of a method according to yet another embodiment. In this embodiment s, the Lagrangian variable q 430 and the Lagrangian variable derivative dq/dt 435 are used to compute a control term 492 based on Equation (6).

Figure 4D:
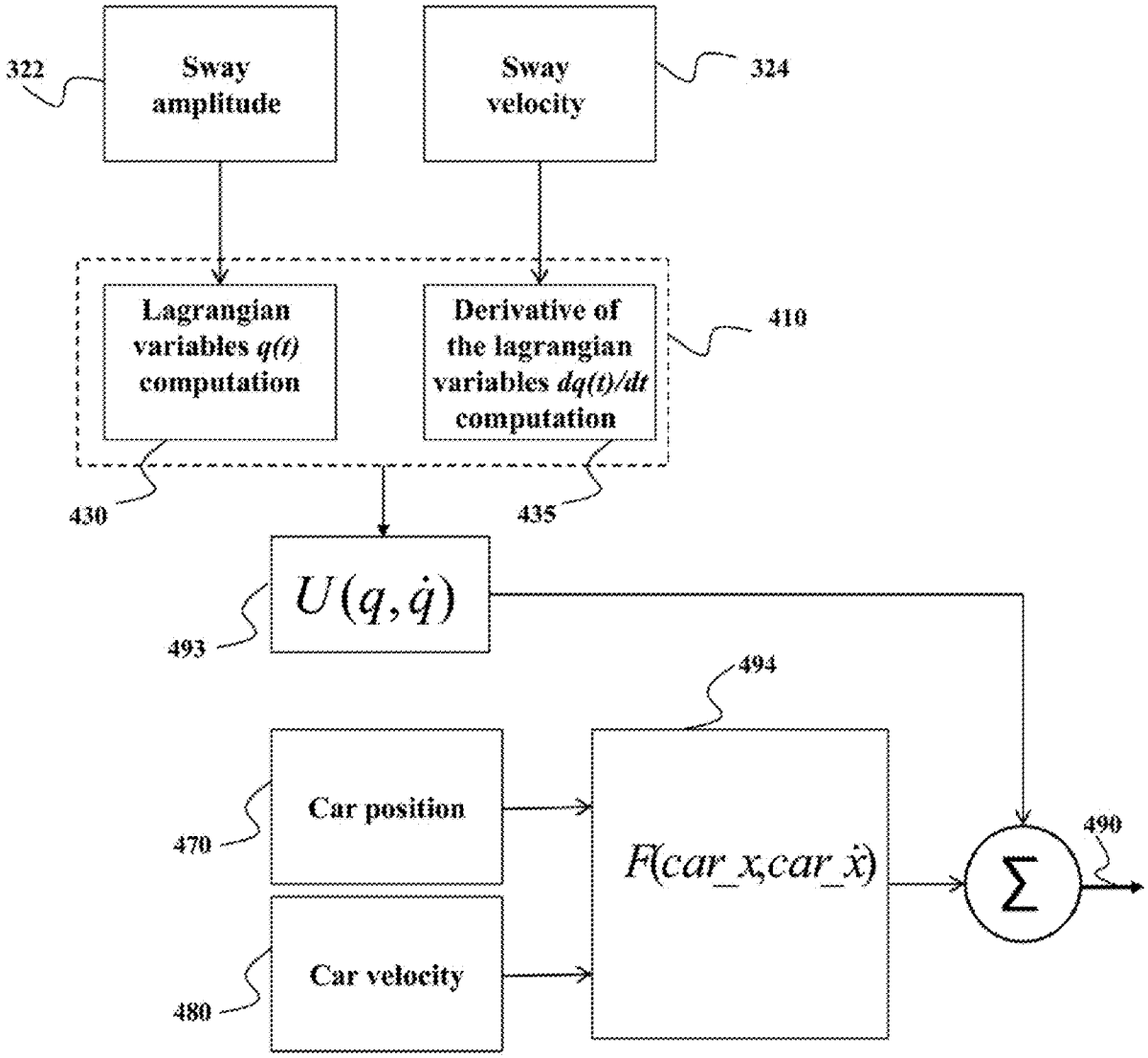
FIG. 4D is a block diagram of a method for computing a tension control and controlling an operation of an elevator system according to an embodiment of the invention.

FIG. 4D shows a block diagram of a method according to yet another embodiment. In this embodiment the control law includes $$W(x)=U(q,\dot{q})+F(\text{car_}x,\text{car_}\dot{x}),$$

wherein F 494 can be any linear or nonlinear function of the states of the elevator car, e.g., the position 470 and the velocity 480 of the elevator car.

Main Sheave Control

For the tension control term EA (car_x−x_u)/l to reproduce the control $$W(x)=\tilde{K}q\dot{q}+Kp\text{car_}x+Kv\text{car_}\dot{x},Kp>0,Kv>0$$

the main sheave has to control the rope length l such that $$l(x)=EA(\text{car_}x+l(0)-x_u(0))/(\tilde{K}q\dot{q}+K_p\text{car_}x+K_v\text{car_}\dot{x}+EA), \quad (17)$$

wherein Kp>0, Kv>0, EA represents the Young modulus E of the elevator rope material multiplied by the cross section A of the elevator rope, l(0) is the initial rope length, x_u(0) is the initial position of the contact point between the rope and the main sheave.

To implement this control law any local controller that drives the main sheave to reproduce a desired rope length can be used. For instance, in some embodiment we can use a local main sheave controller that regulate the main sheave rotation speed and direction based on a desired rope length profile, whereas, the rope length profile is the rope length given by equation (17).

In another embodiment the main sheave has to control the position of the point x_u, such that $$x_u=\text{car_}x-l(\tilde{K}q\dot{q}+K_p\text{car_}x+K_v\text{car_}\dot{x})/EA,K_p>0,K_v>0, \quad (18)$$

To implement this control law any local controller that drives the main sheave to reproduce a desired motion for x_u can be used. For instance, in some embodiment we can use a local main sheave controller that regulate the main sheave rotation speed and direction based on a desired x_u, whereas, the desired x_u is given by equation (18).

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Also, a computer may have one or more input and output devices. These devices can be used, among other things, to present a user interface. Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. For example, some embodiments of the invention use MATLAB-SIMULIMK.

In this respect, the invention may be embodied as a computer readable storage medium or multiple computer readable media, e.g., a computer memory, compact discs (CD), optical discs, digital video disks (DVD), magnetic tapes, and flash memories. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present invention as discussed above.

Computer-executable instructions may be in many forms, such as program modules, executed by one or more computers or other devices. Generally, program modules include routines, programs, objects, components, and data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A method for reducing a sway of an elevator rope supporting an elevator car within an elevator system using a main sheave of the elevator system, comprising:

controlling, using a movement of the main sheave, a tension of the elevator rope according to a control law of the tension between a first point and a second point of the elevator rope, wherein the first point is associated with a contact of the elevator rope with an elevator sheave and the second point is associated with a contact of the elevator rope with the elevator car or a counterweight of the elevator car, wherein the control law is a function of one or combination of a relative position, a relative velocity and a relative acceleration between the first and the second points, wherein the controlling comprises:

determining a state of the sway of the elevator rope and a state of the elevator car;

controlling a movement of the elevator car according to the control law, wherein the control law is a combination of a function of the state of the sway and a function of the state of the elevator car, wherein the function of the state of the sway is determined such that a frequency of the function of the state of the sway is proportional to a frequency of the sway, and wherein the function of the state of the elevator car is determined such that a frequency of the function of the state of the elevator car is different than the frequency of the function of the state of the sway; and repeating periodically the determining and the controlling until a maximum amplitude of the sway is below a threshold, wherein steps of the method are performed by a processor.

2. The method of claim 1, wherein the elevator sheave is the main sheave, the elevator rope is a main elevator rope connecting the elevator car or the counterweight with the main sheave, the first point is a point of contact of the main elevator rope with the main sheave, and the second point is a point of contact of the main elevator rope with the elevator car or with the counterweight.

3. The method of claim 1, wherein the elevator sheave is a compensation sheave, the elevator rope is a compensation rope connecting the elevator car or the counterweight with the compensation sheave, the first point is a point of contact of the compensation rope with the compensation sheave, and the second point is a point of contact of the compensation rope with the elevator car or with the counterweight.

4. The method of claim 1, wherein the elevator sheave is a governor sheave, the elevator rope is a governor rope connecting the elevator car or the counterweight with the governor sheave, the first point is a point of contact of the governor rope with the governor sheave, and the second point is a point of contact of the governor rope with the elevator car or with the counterweight.

5. The method of claim 1, wherein the control law is a function of the state of the sway $U(q,\dot{q})$, wherein, an amplitude of the sway is represented by a variable q and a velocity of the sway represented by a derivative of the variable $\dot{q}$.

6. The method of claim 1, wherein the function of the state of the sway determines the movement of the elevator car reducing the sway, and the function of the state of the elevator car determines the movement of the elevator car stabilizing the elevator car around an initial position.

7. The method of claim 6, wherein the function of the state of the elevator car is proportional to a change of the state of the elevator car from the initial position.

8. The method of claim 1, wherein the function of the state of the sway determines the movement of the elevator car reducing the sway, and the function of the state of the elevator car determines the movement of the elevator car minimizing effect of the sway on the elevator car.

9. The method of claim 1, further comprising:

determining the control law, such that a derivative of a Lyapunov function along dynamics of the elevator system controlled by the control law is negative definite.

10. The method of claim 9, further comprising:

representing a tension of the elevator rope T as the function of the movement of the elevator car according to T=K_rope (car_x−x_u), wherein K_rope is a stiffness of the elevator rope, car_x is the position of the elevator car, and x_u is the position of the contact point between the rope and the main sheave;

determining, based on the model of the elevator system, the Lyapunov function such that an amplitude of the sway is represented by a variable q and a velocity of the sway represented by a derivative of the variable $\dot{q}$;

determining the function of the state of the sway $U(q,\dot{q})$ of the amplitude and the velocity of the sway represented by the variables for controlling a control term U=K_rope (car_x−x_u), such that the derivative of the Lyapunov function is negative definite; and modifying the function $U(q,\dot{q})$ with the function of the state of the elevator car F(car_states), such that the control law W(x) includes $$W(x)=U(q,\dot{q})+F(\text{car_states}),$$

wherein car_states is a vector of states of the elevator car.

11. The method of claim 10, wherein the stiffness of the elevator rope is K_rope=E·A/l, wherein E is a Young modulus the elevator rope, A is a cross section of the elevator rope, and l is a length of the elevator rope.

12. The method of claim 10, wherein the function of the state of the sway includes $$U(q,\dot{q})=\begin{cases}\text{u_max} & \text{if } \dot{q}q>0\\ u^* & \text{if } \dot{q}q\le 0\end{cases},$$

wherein u_max is a positive constant representing a maximum tension, u* is less or equals zero and more or equals −u_max.

13. The method of claim 10, wherein the function of the state of the sway includes $$U(x)=\begin{cases}\dfrac{kq\dot{q}}{\sqrt{1+(q\dot{q})^2}} & \text{if } \dot{q}q>0,\ 0<k\le \text{u_max}\\ 0 & \text{if } \dot{q}q\le 0\end{cases},$$

wherein u_max is a positive constant representing a maximum tension, k is a positive feedback gain.

14. The method of claim 10, wherein the function of the state of the sway includes $\tilde{k}q\dot{q}$, wherein $\tilde{k}$ is a sway gain, further comprising:

determining the sway gain to achieve a maximum sway reduction ratio by a movement of the elevator car within a predetermined range.

15. The method of claim 10, wherein the function of the state of the elevator car includes a position and a velocity of the elevator car, such that the control law W(x) includes $$W(x)=U(q,\dot{q})+Kp\text{car_}x+Kv\text{car_}\dot{x},$$

wherein car_x is the position of the elevator car along an axis x within the elevator shaft, car_ẋ is the velocity of the elevator car, Kp is a position gain of the control law, Kv is a velocity gain of the control law.

16. The method of claim 15, wherein the control law W(x) includes $$W(x)=\tilde{k}q\dot{q}+Kp\text{car_}x+Kv\text{car_}\dot{x},$$

wherein k̃ is a sway gain, wherein the sway gain, the position gain, and the velocity gain are positive.

17. The method of claim 2, further comprising:

controlling the main sheave to change a position x_u of the first point according to $$x_u=\text{car_}x-l(\tilde{K}q\dot{q}+K_p\text{car_}x+K_v\text{car_}\dot{x})/EA, K_p>0, K_v>0,$$

wherein EA represents a Young modulus E of material of the elevator rope multiplied by a cross section A of the elevator rope, wherein car_x is a position of the elevator car along an axis x within the elevator shaft, car_ẋ is a velocity of the elevator car, k̃ is a sway gain of the elevator rope, Kp is a position gain of the elevator car, Kv is a velocity gain of the elevator car, wherein and the sway, the position and the velocity gains are positive feedback gains, q and q̇ are Lagrangian variables representing an amplitude and a velocity of the sway.

18. The method of claim 2, further comprising:

controlling the main sheave to change a position x_u of the first point according to $$x_u=\text{car_}x-l(\tilde{K}q\dot{q})/EA,$$

wherein EA represents a Young modulus E of material of the elevator rope multiplied by a cross section A of the elevator rope, wherein k̃ is a sway gain of the elevator rope, q and q̇ are Lagrangian variables representing an amplitude and a velocity of the sway.

19. The method of claim 17, wherein the control unit controls the sheave to change the length of the elevator rope l(x) between the sheave and the elevator car according to $$l(x)=EA(\text{car_}x+l(0)-x_u(0))/(\tilde{K}q\dot{q}+K_p\text{car_}x+K_v\text{car_}\dot{x}+EA),$$

wherein EA represents a Young modulus E of material of the elevator rope multiplied by a cross section A of the elevator rope, wherein l(0) is an initial rope length, x_u(0) is an initial position of a contact point between the elevator rope and the sheave, wherein car_x is a position of the elevator car along an axis x within the elevator shaft, car_ẋ is a velocity of the elevator car, k̃ is a sway gain of the elevator rope, Kp is a position gain of the elevator car, Kv is a velocity gain of the elevator car, wherein the sway gain, the position gain and the velocity gain are positive feedback gains, q and q̇ are Lagrangian variables representing an amplitude and a velocity of the sway.

20. A method for reducing a sway of an elevator rope supporting an elevator car within an elevator system using a main sheave of the elevator system, comprising:

controlling, using a movement of the main sheave, a tension of the elevator rope according to a control law of the tension between a first point and a second point of the elevator rope, wherein the first point is associated with a contact of the elevator rope with an elevator sheave and the second point is associated with a contact of the elevator rope with the elevator car or a counterweight of the elevator car, wherein the control law is a function of one or combination of a relative position, a relative velocity and a relative acceleration between the first and the second points, wherein the controlling comprises:

determining a state of the sway of the elevator rope and a state of the elevator car;

controlling a movement of the elevator car according to the control law, wherein the control law is a combination of a function of the state of the sway and a function of the state of the elevator car, and wherein the control law is determined such that a derivative of a Lyapunov function along dynamics of the elevator system controlled by the control law is negative definite; and repeating periodically the determining and the controlling until a maximum amplitude of the sway is below a threshold, wherein steps of the method are performed by a processor.

* * * * *